United States Patent [19]

Westfall

[11] 4,121,753

[45] Oct. 24, 1978

[54] SHIPPING CONTAINER AND BLANK THEREFOR

[75] Inventor: Jackie R. Westfall, Vincennes, Ind.

[73] Assignee: Packaging Corporation of America, Evanston, Ill.

[21] Appl. No.: 758,572

[22] Filed: Jan. 12, 1977

[51] Int. Cl.[2] ..... B65D 5/02

[52] U.S. Cl. ..... 229/37 R

[58] Field of Search ..... 229/37 R, 37 E, 48 SA, 229/6 R, 16 R

[56] References Cited

U.S. PATENT DOCUMENTS

| | | | |
|---|---|---|---|
| 3,409,205 | 11/1968 | Meyers | 229/37 R |
| 3,511,431 | 5/1970 | Silver | 229/37 R |
| 3,522,906 | 8/1970 | Painter | 229/37 E |
| 3,561,669 | 2/1971 | Postweiler et al. | 229/37 E |
| 3,825,170 | 7/1974 | Aust et al. | 229/37 E |

*Primary Examiner*—William Price
*Assistant Examiner*—Joseph Man-Fu Moy
*Attorney, Agent, or Firm*—Neuman, Williams, Anderson & Olson

[57] ABSTRACT

A shipping container is provided having a manufacturer's joint formed between the edges of a pair of adjacent wall sections. The manufacturer's joint includes a first joint flap which is foldably connected to a vertical edge of one of the adjacent wall sections and is secured to the concealed surface of the second of the wall sections. The second wall section is provided with a second joint flap which is foldably connected to the vertical edge thereof and is secured to the exposed surface of the first mentioned wall section. The second joint flap includes longitudinal extensions which are secured in overlying relation to top and bottom closure flaps foldably connected to opposite edges of the first mentioned wall section.

2 Claims, 7 Drawing Figures

FIG. 3
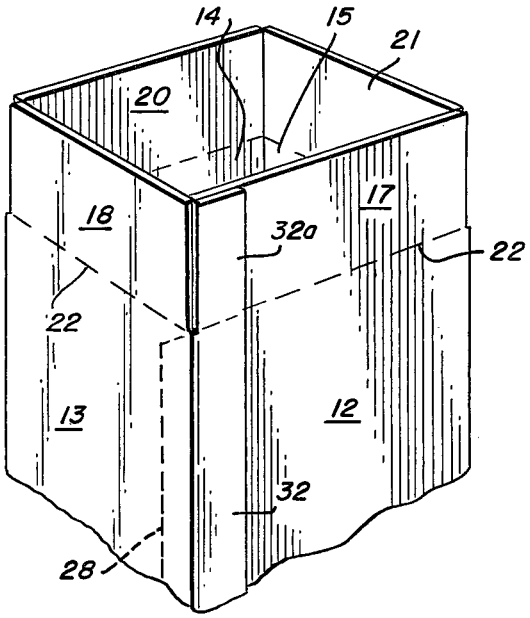
FIG. 4
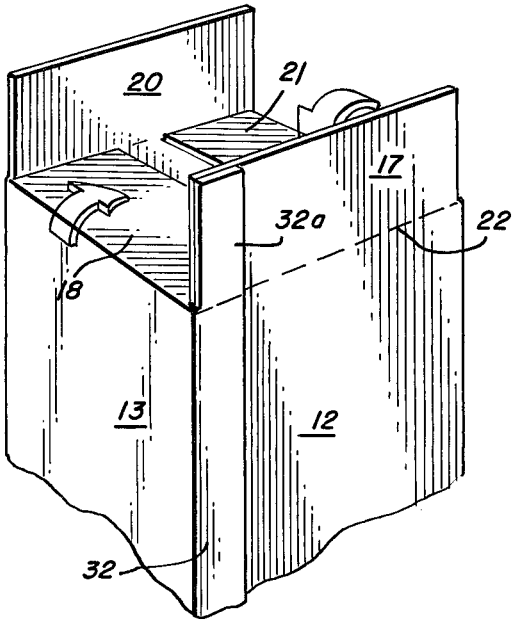
FIG. 5
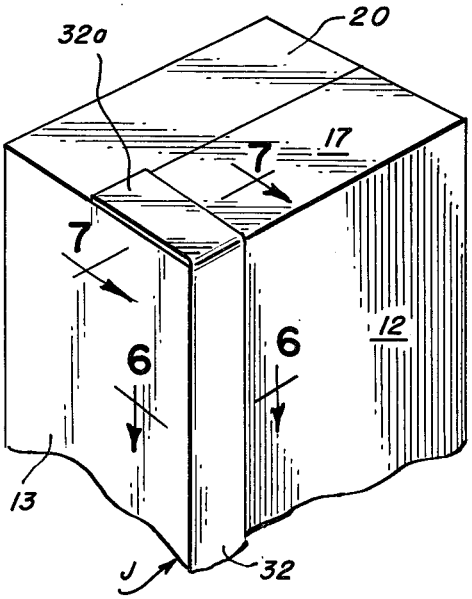
FIG. 6
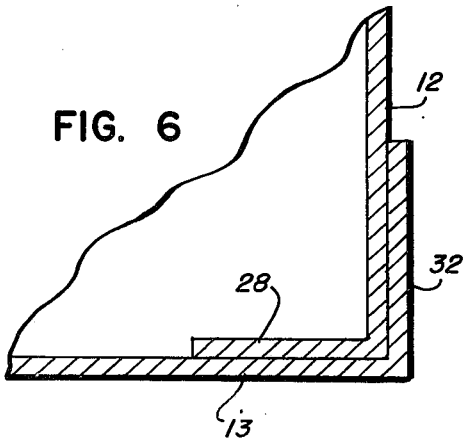
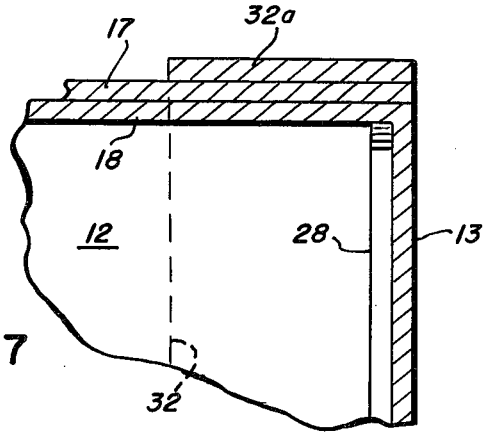
FIG. 7

SHIPPING CONTAINER AND BLANK THEREFOR

BACKGROUND OF THE INVENTION

In shipping containers having wax-coated interior surfaces difficulty has heretofore been encountered in obtaining an effective bond at the manufacturer's joint, particularly where the contents of the containers are heavy. To rectify this situation, the use of staples was frequently employed; however, in certain instances the use of staples or stitching was undesirable because of the possibility that such staples or stiching might damage and/or contaminate the accommodated product. In other instances, where the staples were not used, special gluing equipment and/or glue formulations were required thereby significantly increasing the cost of the container.

SUMMARY OF THE INVENTION

Thus, it is an object of this invention to provide a shipping container which overcomes the aforenoted shortcomings.

It is a further object of the invention to provide a shipping container which is of simple inexpensive construction and may be readily set up manually or by automatic or semiautomatic equipment.

It is a still further object of the invention to provide a reinforced manufacturer's joint which is capable of being incorporated in containers varying in sizes and shapes over a wide range.

Further and additional objects will appear from the description, accompanying drawings, and appended claims.

In accordance with one embodiment of the invention a shipping container having a reinforced manufacturer's joint is provided wherein a first joint flap is foldably connected to the vertical edge of a first joint-forming wall section and is secured to the concealed surface of a second joint-forming wall section. A second joint flap is foldably connected to the vertical edge of the second wall section and is secured to the exposed surface of the first wall section. The second joint flap is provided with foldable longitudinal extensions which are secured to the exposed surfaces of the top and bottom closure flaps which in turn are foldably connected to the top and bottom edges of the first wall section.

DESCRIPTION

For a more complete understanding of the invention reference should be made to the drawings wherein:

FIGS. 3–5 are fragmentary perspective views showing one sequence of folding steps to effect closing the top of a container formed from the blank of FIG. 1.

FIGS. 6 and 7 are enlarged fragmentary sectional views taken along lines 6—6 and 7—7, respectively, of FIG. 5.

Figure 1:
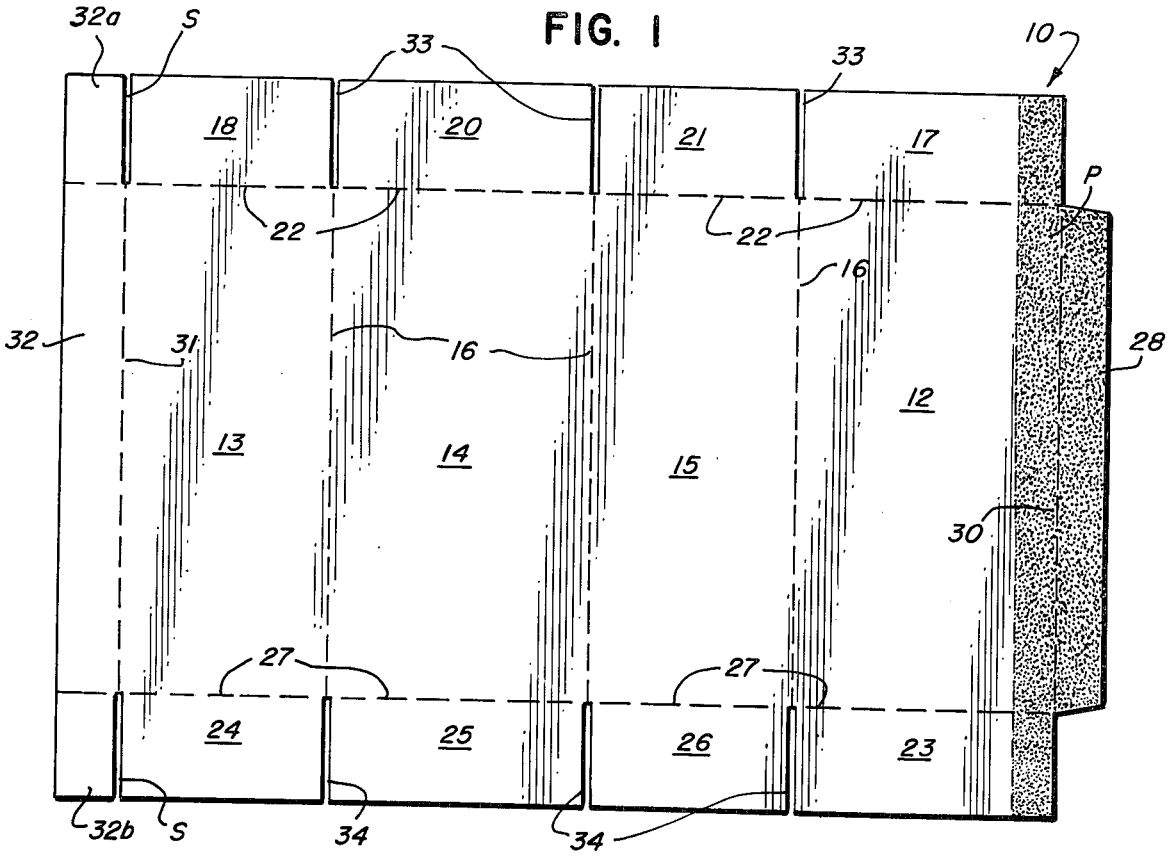
FIG. 1 is a top plan view of one form of a blank for a shipping container having the improved reinforced manufacturer's joint and showing the adhesive pattern therefor applied to the undersurface thereof.

Referring now to the drawings and more particularly to FIG. 1, one form of an improved blank 10 is shown which is adapted to be set up to form a shipping container 11 having an improved reinforced manufacturer's joint J. The joint J is disposed between first and second wall sections 12 and 13, which, as shown in FIG. 1, are the endmost wall sections. Sections 12, 13 are separated from one another by a pair of wall sections 14, 15. The wall sections of blank 10 are disposed in side-by-side relation and adjacent sections are connected to one another by foldlines 16. The number, size and shape of the wall sections comprising the blank 10 may vary from that shown and will depend upon the type of product being packaged within the container. As seen in FIG. 1, wall sections 13, 15 are narrower than sections 12, 14. The corresponding upper edges of wall sections 12–15 have respective top closure flaps 17, 18, 20 and 21 connected thereto by foldlines 22. In a similar manner, the corresponding lower edges of the wall sections have respective bottom closure flaps 23, 24, 25 and 26 connected thereto by foldlines 27.

Wall section 12 has a joint flap 28 connected to the outer vertical edge thereof by an elongated foldline 30. Connected by foldline 31 to the outer vertical edge of wall section 13 is a second joint flap 32. Extending longitudinally from opposite ends of flap 32 are foldable extensions 32*a* and 32*b*. Each extension is separated from the adjacent closure flap 18, 24 by a slit S which is aligned with foldline 31. The adjacent top closure flaps are separated from one another by a conventional slot 33. In a corresponding manner, adjacent bottom closure flaps are separated from one another by a conventional slot 34. Each slot 33, 34 is aligned with a corresponding foldline 16.

Figure 2:
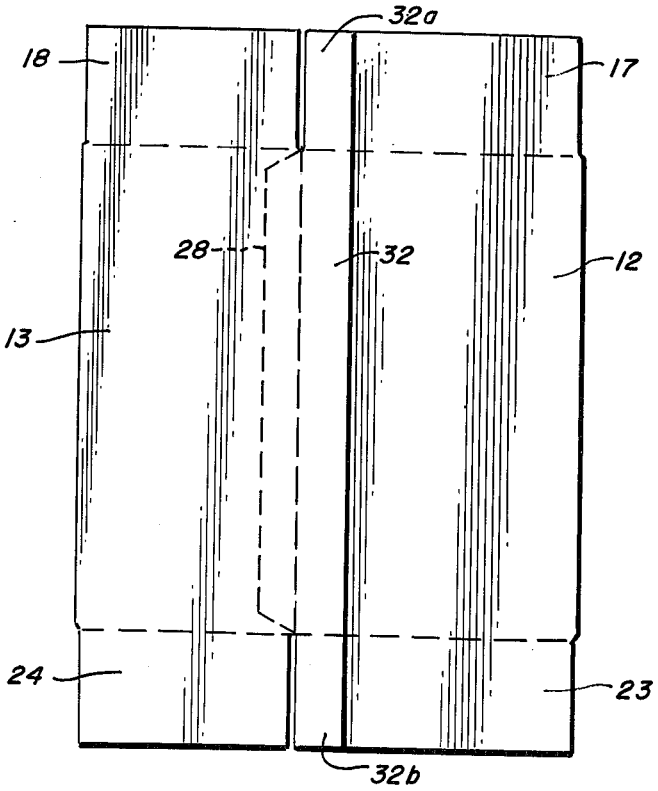
FIG. 2 is similar to FIG. 1 but showing the blank in an initial folded condition.

To attain the collapsed, initially folded condition shown in FIG. 2, wall section 12, first joint flap 28, and associated closure flaps 17, 23 are folded as a unit about the foldline 16 interconnecting sections 12, 15 so as to overlie the exposed surface of wall section 15 and partially overlie the exposed surface of section 14. Subsequently, wall section 13, second joint flap 32 and extensions 32*a*, 32*b*, and associated closure flaps 18, 24 are folded as a unit about foldline 16 interconnecting wall sections 13, 14 so as to overlie the exposed surface of wall section 14 and the adhesively coated surface of flap 28 and wall section 12. Prior to the initial folding step, suitable adhesive is applied by a conventional glue wheel or the like to the undersurface of flap 28, wall section 12 and closure flaps 17, 23 so as to form the adhesive pattern P, shown in FIG. 1. After the initial folding step is completed the first joint flap 28 will be bonded to the interior, or concealed, surface of wall section 13, and the second joint flap 32 will overlie and be bonded to the exterior, or exposed, surface of wall section 12. Simultaneously therewith extensions 32*a*, 32*b* will overlie and be bonded to the exterior, or exposed, surfaces of respective closure flaps 17, 23, see FIG. 2.

In certain instances it may be desirable to modify the initially folded blank so as to have the flap 28 secured to the exposed surface of wall section 13 and the second flap 32 and extensions 32*a*, 32*b* secured to the concealed surfaces of wall section 12 and closure flaps 17 and 23. In this latter situation the initial folding step is varied slightly. First, the adhesive pattern is applied to the exposed surface of the blank of FIG. 1 but in the same location. Second, the wall section 13, closure flaps 18, 24 and associated flap 32 and extensions 32*a*, 32*b* are initially folded as a unit about a foldline 16 so that wall section 13 and flap 32 overlie wall section 14. Lastly, wall section 12, closure flaps 17, 23 and flap 28 are folded as a unit about the second foldline 16 so that flap 28 is secured to the outside surface of wall section 13 and the flap 32 is secured to the interior surface of wall section 12 and the extensions 32*a*, 32*b* secured to the interior surfaces of closure flaps 17 and 23, respectively.

The partially folded blank (FIG. 2) while in such a state can be stored for subsequent loading or shipped to the customer in bulk with other like blanks. In either case, the partially folded blank occupies a minimum amount of space.

FIGS. 3–5 illustrate the successive steps of setting up the blank for loading and then closing the loaded container. In FIG. 3 the blank of FIG. 2 has been manipulated so that the wall sections 12–15 are squared up to form a sleeve. The bottom closure flaps are first folded relative to one another and the wall sections so as to form a closed bottom. The sequence of folding the bottom closure flaps is identical to that of the top closure flaps to be hereinafter described in regards to FIGS. 3–5.

FIG. 3 illustrates the shipping container 11 ready for loading after the bottom closure flaps 23–26 have been folded so as to form a closed bottom. After the product, not shown, has been loaded into the container through the open top, closure flaps 18, 21 are folded towards one another about foldlines 22 so as to assume a substantially coplanar relation, see FIG. 4. Closure flap 20 is then folded inwardly so as to overlie previously folded flaps 18, 21. Flap 20 is normally adhesively secured to flaps 18, 21. Flap 17 with the extension 32*a* affixed to the exterior thereof is then folded inwardly so as to overlie and be adhesively secured to flap 20. When the flap 17 is affixed in overlapping relation with flap 20, the extension 32*a* will cooperate with extension 32*b* which is affixed to folded bottom closure flap 23 and snugly retain the flap 32 in positive adhesive engagement with the exterior of wall section 12.

When the modified initially folded blank is utilized the folding sequence is the same as that described above, except the respective extensions 32*a*, 32*b* will be sandwiched between the top closure flaps 17, 18 and the bottom closure flaps 23, 24.

The accommodated product may in certain instances help to retain joint flap 28 in adhesive engagement with the interior surface of wall section 13. Thus, joint flaps 28, 32 cooperate with the respective wall sections 13, 12 to form an effective reinforced manufacturer's joint J.

I claim:

1. A shipping container formed from a blank of foldable sheet material having a first surface and a second surface, said container comprising a plurality of upright side wall panels foldably connected to one another; closure flaps foldably connected to the upper and lower edges of said side wall panels and forming a closed top and a closed bottom, said top and bottom being substantially horizontally disposed relative to said side wall panels; an elongated first joint flap foldably connected to and projecting laterally from an upright edge of a first joint-forming side wall panel and having a length substantially coextensive with said upright edge, said first joint flap being adhesively secured to a portion of a second joint-forming side wall panel disposed adjacent an upright edge thereof and forming the blank first surface; an elongated second joint flap foldably connected to and projecting laterally from the upright edge of said second joint-forming side wall panel and having a length substantially coextensive therewith, said second joint flap being adhesively secured to a portion of said first joint-forming side wall panel disposed adjacent the upright edge thereof and forming the blank second surface, the foldline connections of the first and second joint flaps being disposed in substantially superposed coextensive relation; and elongated extensions foldably connected to opposite ends of said second joint flap and extending longitudinally therefrom, said extensions being adhesively secured to the surfaces of the closure flaps connected to the first joint-forming side wall panel and forming the blank second surface, the foldline connection of each extension being in substantially aligned overlying relation with the foldline connection of the closure flap to which it is secured, said extensions being in spaced substantially parallel relation to each other and transversely disposed with respect to said second joint flap; the adhesive securing said first joint flap and said second joint flap to the respective joint-forming side wall panels and said extensions to the respective closure flaps being in the form of a continuous stripe of adhesive having been applied only to the blank second surface of said first joint flap, of said first joint-forming side wall panel, and of the closure flaps connected to said first joint-forming side wall panel.

2. The shipping container of claim 1 wherein the blank first surface forms the interior surface of the container and the blank second surface forms the exterior surface of the container.

* * * * *